US006871482B2

(12) United States Patent
Cirio

(10) Patent No.: US 6,871,482 B2
(45) Date of Patent: Mar. 29, 2005

(54) DEVICE FOR SCREWING A CAP ONTO THE NECK OF A BOTTLE OR SIMILAR CONTAINER

(75) Inventor: Sergio Cirio, Canelli (IT)

(73) Assignee: Arol SpA, Asti (IT)

( * ) Notice: Subject to any disclaimer, the term of this patent is extended or adjusted under 35 U.S.C. 154(b) by 41 days.

(21) Appl. No.: 10/649,782

(22) Filed: Aug. 28, 2003

(65) Prior Publication Data

US 2004/0065049 A1 Apr. 8, 2004

(30) Foreign Application Priority Data

Oct. 2, 2002 (IT) ..... 2002A000855

(51) Int. Cl.[7] ..... B67B 3/20
(52) U.S. Cl. ..... 53/490; 53/317
(58) Field of Search ..... 81/320; 53/485, 53/490, 317, 331.5, 75

(56) References Cited

U.S. PATENT DOCUMENTS 5,419,094 A * 5/1995 Vander Bush et al. ..... 53/75
5,457,936 A * 10/1995 Neel ..... 53/317
6,044,626 A * 4/2000 Harper et al. ..... 53/490
6,158,196 A * 12/2000 Trebbi et al. ..... 53/331.5
6,679,026 B1 * 1/2004 Cirio ..... 53/317

FOREIGN PATENT DOCUMENTS

EP 1 103 513 A1 5/2001
FR 2 351 563 A 12/1977

* cited by examiner

*Primary Examiner*—Jacob K. Ackun, Jr.
(74) *Attorney, Agent, or Firm*—Sughrue Mion, PLLC

(57) ABSTRACT

A screwing head for screwing a cap onto a bottle or similar container comprises a thruster member positioned within the rotating organ for gripping the cap which is thrust against the cap during a step previous to the start of the cap screwing step, in order to drive the cap onto the neck of the bottle, as well as during the cap screwing step, and during a step following the completion of the screwing of the cap.

11 Claims, 3 Drawing Sheets

DEVICE FOR SCREWING A CAP ONTO THE NECK OF A BOTTLE OR SIMILAR CONTAINER

BACKGROUND OF THE INVENTION

The present invention relates to devices for screwing caps onto the neck of bottles or similar containers, of the type comprising a screwing head axially movable along a screwing axis and able to rotate about said axis to transmit a rotation to an organ destined to grip the cap, in synchronism with the axial movement of the head, to cause the cap to be screwed onto the bottle, in which said gripping organ has a tubular shape, with an end mouth which is able to receive and grip the cap therein, in which inside each tubular grip organ is mounted in sliding fashion a thruster member, and in which means are provided for controlling the axial position of said thruster member within the grip organ.

SUMMARY OF THE INVENTION

In the present description and in the claims that follow, reference is generally made to any bottle or similar container whose neck has a thread or otherwise a conformation equivalent to a thread, and whose cap has a capsule conformation, with a cylindrical cladding having an inner surface which bears a thread or equivalent surface which engages the thread of the bottle neck to achieve the screw-on coupling.

Devices of the type specified above have already been produced and marketed by the same applicant. In known devices, the aforesaid thruster member is moved axially towards the end of the tubular organ bearing the aforesaid mouth for gripping the cap, to expel the cap if it has accidentally become jammed in side the grip organ or for the mechanical control of a set of pliers for gripping the cap.

The aim of the present invention is to improve known devices, especially from the point of view of operating reliability, for example reducing the risk of defective screw-on couplings due to an initial positioning of the cap that was not aligned relative to the bottle neck.

An additional aim of the invention is to achieve the aforesaid result with extremely simple and inexpensive means.

In view of achieving these and additional aims, the invention relates to a device having all the characteristics set out at the start of the present description and further characterised by the fact that the aforesaid means for controlling the axial position of the thruster member relative to the tubular organ for gripping the cap are able to cause an axial movement of the thruster member inside the grip organ so as to thrust it against the cap on the bottle during at least a time interval elapsing between the instant in which the cap is set down on the bottle, before its screwing starts, and an instant subsequent to the completion of the screwing, when the screwing head rises again, moving away from the cap.

In a preferred embodiment, the thruster member is commanded to exert a continuous axial thrust on the cap starting from an instant which precedes the start of the screwing step, until an instant which is subsequent to the completion of the screwing, when the screwing head has already risen again.

Thanks to this characteristic, the achievement of a screwing coupling of the cap on the bottle in a correct position is better assured. In particular, the thrust exerted by the thruster member against the cap even before the start of the screwing step allows to obtain an axial planting of the cap onto the threaded portion of the bottle neck, whereon the threaded inner surface of the cap is engaged. The axial planting is such as to allow the overtaking of the threads by the entire collar constituting the usual safety seal associated with the lower edge of the capsule cap, in order immediately to obtain a reliable contact between the threads of the capsule cap and the threads of the container.

Moreover, the thrusting action exerted by the thruster member on the cap during the screwing step assures that the cap remains positioned correctly during said step.

Lastly, preferably, the thruster member is also used to exert its thrust against the cap even when, after the screwing is completed, the screwing head starts to rise again moving away from the cap, to prevent the entire bottle with the cap integral therewith to be set in rotation by the screwing head, which is still rotating.

Naturally, if obtaining this effect is desired, it is necessary for the thruster member not to rotate when the grip organ is still rotating. For this purpose, according to an additional characteristic of the invention, the thruster member is mounted inside the grip organ with the interposition of rotary support means, for instance a rolling bearing.

It is also evident that, although in the preferred embodiment the thruster member is used to exert a thrust against the cap in continuous fashion starting from a step preceding the start of the screwing operation until a step subsequent to the completion of the screwing operation, the scope of the present invention includes any alternative device in which the thruster member is used to exert the aforesaid thrust only in one of the steps described above.

Lastly, the thruster member of the device according to the invention can naturally be used, similarly to what is already known, as an ejector element if a cap remains jammed in the mouth of the grip organ of the device.

Additionally according to a further characteristic, the aforesaid means for controlling the axial position are constituted by cam means. It should be noted that in a concrete embodiment, it is advantageous to provide a plurality of devices according to the invention arranged in a carousel mechanism, according to a technique known in itself, in association with an equal number of bottles, in such a way that the screwing step is performed while each screwing head and the related bottle thereunder move along a circular trajectory about the central axis of the carousel mechanism. In accordance with the prior art, the axial displacements of the various screwing heads are also achieved with cam means constituted by a shaped, stationary circumferential track in which are engaged cam-following organ, each integral, with reference to axial movements, with a respective screwing head. According to the invention, to the cam track which controls the axial movements of the screwing heads is associated an additional cam track which is engaged by cam-following organs which are integral, with reference to the axial movements, to the respective thruster members of the various screwing heads. The two aforesaid cam tracks are so shaped as to obtain the desired cycle of axial movements of the screwing heads and of the thruster members during the rotation of the carousel mechanism.

BRIEF DESCRIPTION OF THE DRAWINGS

Additional characteristics and advantages of the invention shall become more readily apparent from the description that follows with reference to the accompanying drawings, provided purely by way of non limiting example, in which.

DETAILED DESCRIPTION OF THE INVENTION

Figure 1:
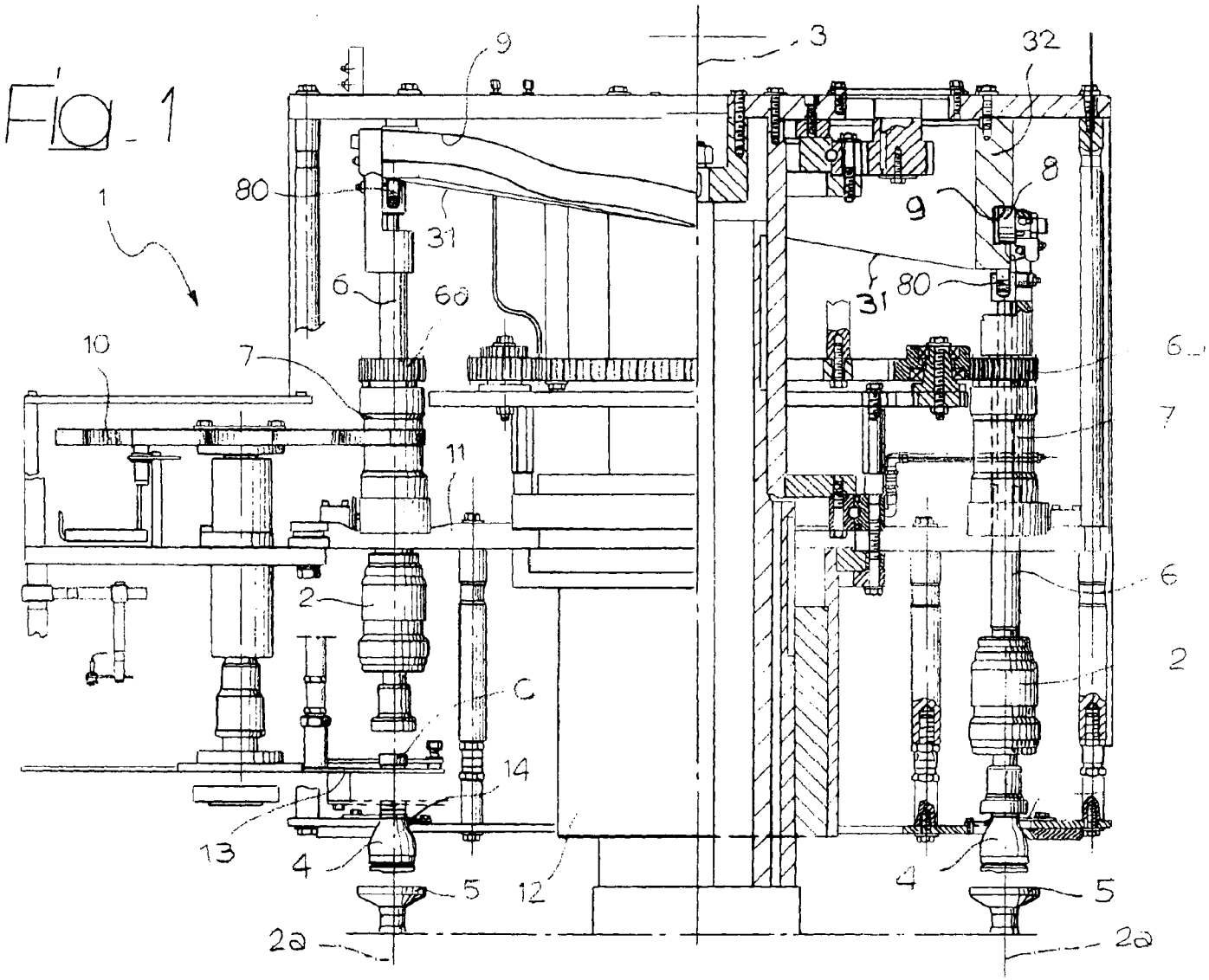
FIG. 1 is a schematic partial elevation view, with partially sectioned parts, of a carousel mechanism using a plurality of devices according to the invention.

In FIG. 1, the reference number 1 globally designates a carrousel mechanism in which a plurality of screwing heads 2 are driven to rotate about a central axis 3 whilst remaining each above a respective bottle 4 (whose body is shown only partially in FIG. 1) set down onto a base 5 which follows the related screwing head 2 in its rotation motion about the central axis 3. The body of each screwing head 2 is supported by a respective vertical shaft 6 which is integral in rotation with the screwing head and which is guided axial within a guiding bushing 7. Each shaft 6 has an upper end projecting above the guiding bushing 7 which bears a cam-following roller 8 engaged in a circumferential track 9 serving as a cam. The guiding bushings 7 are intercepted one at a time by a star guide 10 which is driven in rotation to actuate inferiorly a wheel for feeding the caps. The stepped advance of the entire carrousel mechanism and in particular of the circumferential series of the guiding bushings 7 about the central axis 3 is transmitted by means of a disk 11 whereon are set the bushings 7 by a motorised central body 12, which also drives in rotation the bases 5 bearing the bottles 4. During its cycle of rotation about the central axis 3, each screwing head moves axially, i.e. in the direction of the respective axis 2*a*, by effect of the engagement of the cam following roller 8 in the cam track 9, in order to achieve the screwing cycle of each cap onto the respective bottle, as shall be described in greater detail below. During said cycle, each screwing head 2 is driven in rotation to command the screwing of the respective cap onto the respective bottle. Said screwing rotation, which takes place about the axis 2*a*, is obtained by effect of the meshing of a gear wheel 6*a* which is connected in rotation to each vertical shaft 6 with a driving gear transmission 6*b*.

It should be noted that the characteristics described heretofore of the carrousel mechanism are known in themselves, and common to all devices of this kind produced and marketed also by the same applicant. The description of this part of the machine is therefore intentionally reduced and simplified, since the aforesaid characteristics of the carrousel mechanism do not fall within the scope of the present invention.

FIG. 1 also shows a horizontal plate 13 whereon the caps C coming from a cap magazine (not shown) are deposited in succession to be withdrawn each by a respective screwing head and positioned over a respective bottle. FIG. 1 also shows how each bottle is held, adjacently to its neck, by retaining members 14 borne by the equipment rotating about the central axis 3 of the carrousel.

Figure 2:
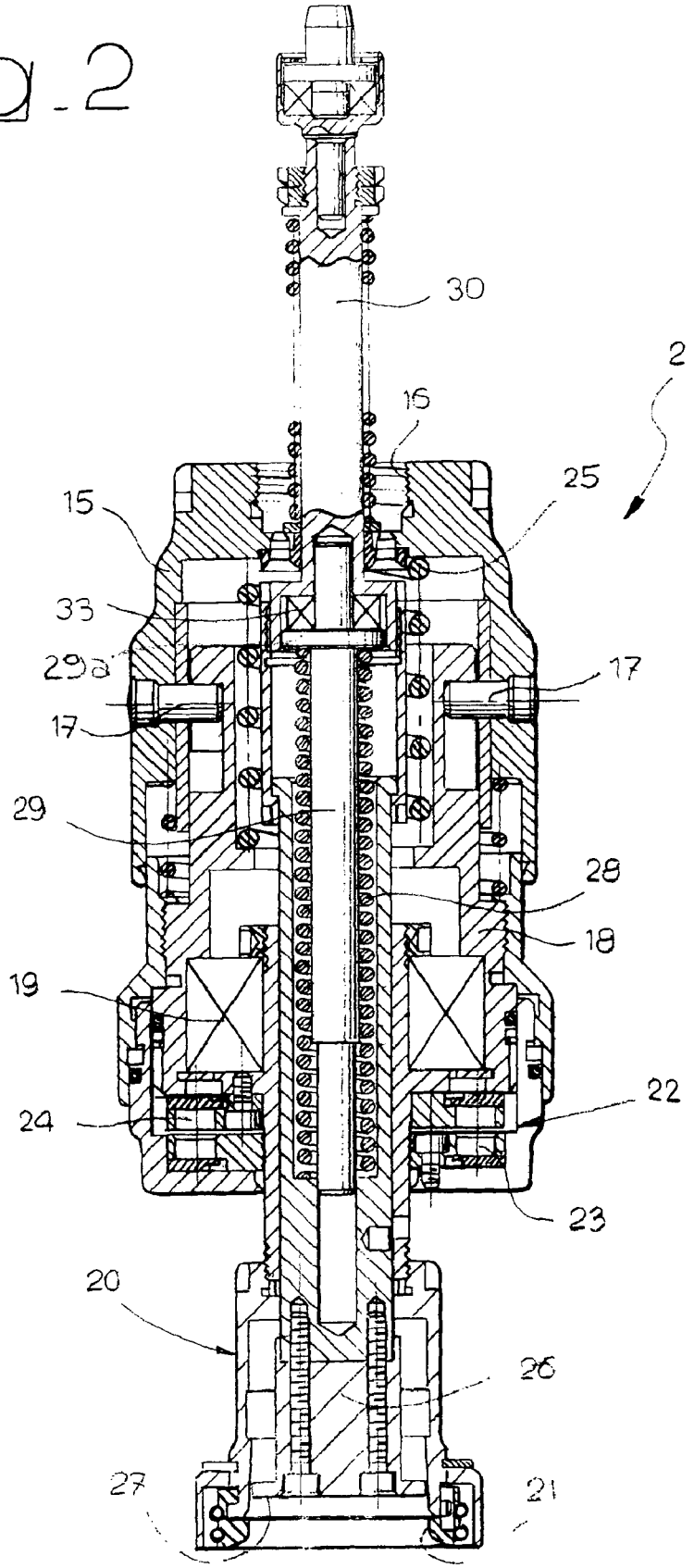
FIG. 2 shows a section view of a screwing head according to a preferred embodiment of the invention.

FIG. 2 shows a section view of a screwing head according to the invention. The general structure of the head shown in FIG. 2 is substantially similar to that of known, conventional screwing heads. For this reason, in this case as well said structure shall be described only in its more general essential elements. The reference number 15 shows the body which is connected in rotation with the shaft 6 (not visible in FIG. 2). The lower end of the shaft 6 (which is a tubular shaft) is received and screwed into an upper end cavity 16 of the body 15. Therefore, the driving rotation imparted by the gear transmission 6*b* to the shaft 6 is transmitted to the body 15. The body 15 is integral in rotation, through radial pins 17, with an inner bushing 18. Inside the bushing 18 is in turn mounted in rotary fashion, by means of the interposition of a rolling bearing 19, a tubular organ 20 for gripping the cap, whose lower end terminates with a mouth 21 for gripping the cap. The rotation imparted to the body 15 is transmitted to the bushing 18 and therefrom to the grip organ 20 by means of a torque limiter joint, or clutch, 22 of the magnetic type, comprising a first circumferential series of magnets 23 borne by a plate, integral in rotation with the bushing 18, and a second circumferential series of magnets 24, axially facing the magnets 23, and borne by a second plate, integral in rotation with the grip organ 20. The axial distance between the magnets 23 and the magnets 24 is adjustable, using known means which are not further described herein, to obtain an adjustment of the tightening torque of the cap. During the screwing step, the clutch 22 transmits the rotation imparted by the shaft 6 to the gripping organ 20 until the resisting torque exerted by the cap at the end of the screwing operation exceeds a predetermined threshold value, beyond which the clutch 22 slips so the grip organ remains stationary whilst the rotating drive shaft 6, and therewith the body 15 of the screwing head 2 continues to rotate.

As stated, all the characteristics set out above of the screwing head 2 are known in themselves and thus do not fall within the scope of the present invention. Also known is the arrangement of a helical spring 25 axially interposed between an end wall of the body 15 and an axial abutment of the inner bushing 18. When the grip organ 20 presses axially onto a respective cap as a result of a lowering of the respective shaft 6, the spring 25 serves as a compensating organ able to transmit the axial stress imparted to the body 15 to the cap gripping organ 20.

Also according to the prior art, inside the tubular grip element 20 is positioned a thruster member 26 which is mounted in sliding fashion axially within the grip organ 20. The thruster organ 26 inferiorly terminates with a thruster plate 27 destined to come in contact with the upper surface of the cap. The thruster member 26 can be thrust downwards as a result of the force exerted by a helical spring 28, through the flat base 29*a* of a stem 29. The stem 29, whose purpose is to guide the spring 28, is connected to an additional stem 30 which projects above the screwing head 2 inside the tubular shaft 6 (not shown in FIG. 2). As shown in FIG. 1, the stem 30 is superiorly connected to an additional extension stem whose upper end projects from the upper end of the shaft 6 and bears a cam following roller 80 which engages a second cam surface 31. As FIG. 1 shows, the cam track 9 is constituted by a circumferential groove obtained in a cylindrical wall, whilst the cam surface 31 is defined by the annular lower end edge of said cylindrical wall (designated by the reference number 32 in FIG. 1).

In the screwing head according to the invention, an important difference from the prior art is constituted by the fact that a rolling bearing 33 is provided in the connection between the stem 29 and the stem 30. Thanks to said element, the thruster member 26 can be in stationary position, whilst the grip organ 20 rotates, which is advantageous, for the purposes of the present invention, in the step subsequent to the completion of the cap, as shall become more readily apparent below.

Figure 3:
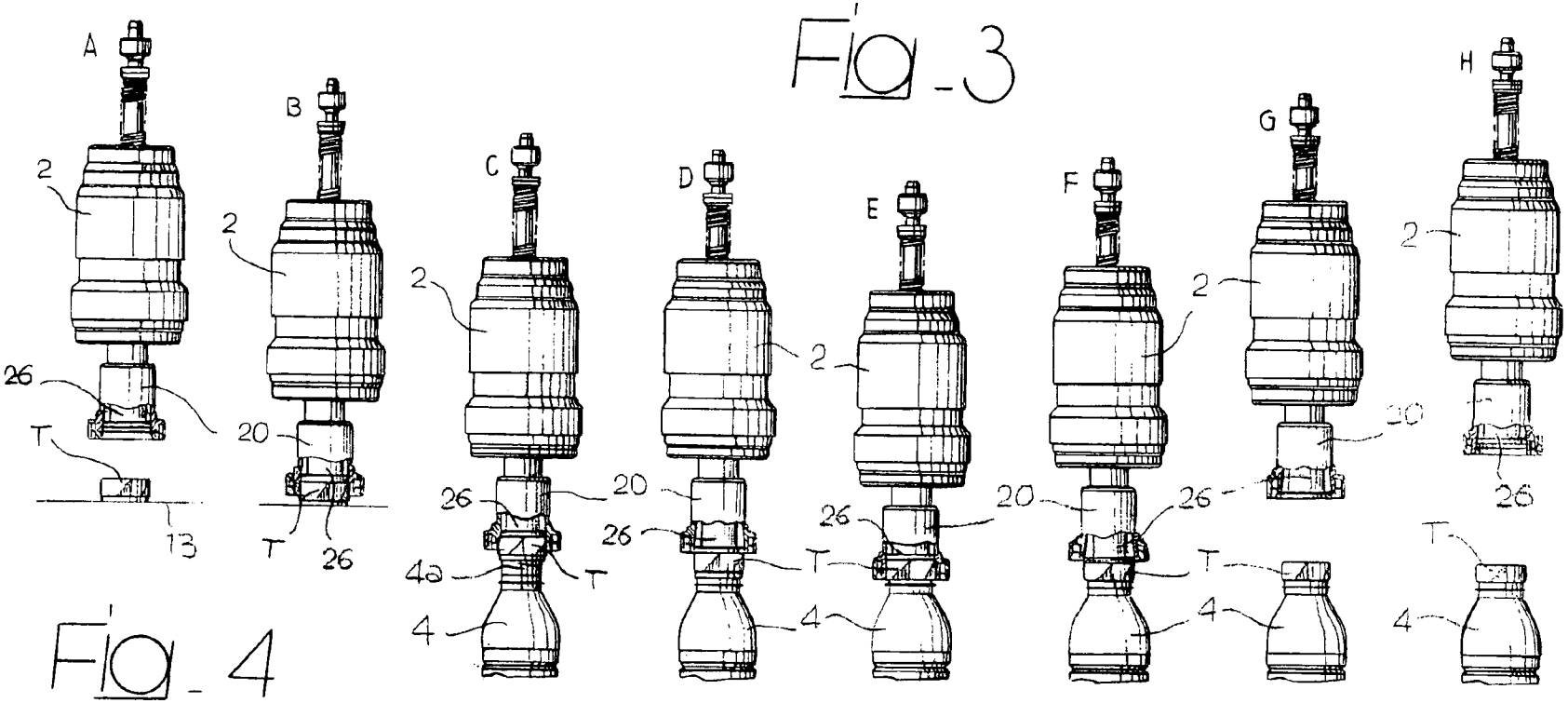
FIG. 3 shows the cycle of movements of the screwing head and of the related ejector element, before, during and after the step of screwing the cap onto the bottle.
Figure 4:
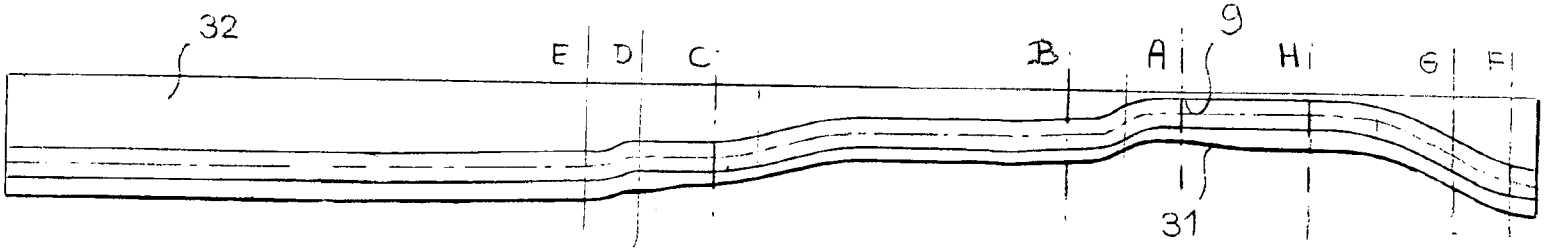
FIG. 4 is a development in the plane of the cam track and of the cam surface which control the axial movement respectively of the screwing heads and of the related thruster members.

FIG. 4 shows a development in the plane of the wall 32 with the shaped throat 9 and the cam surface 31. FIG. 3 shows the axial positions of a screwing head 2 and of the respective thruster member 26 relative to the cap T and to the respective bottle 4 during the operating cycle of the machine. The positions illustrated and designated by the letters A–H in FIG. 3 correspond to those designated by the corresponding letters in FIG. 4.

In the condition of FIG. 3A, the cap T is still set down onto the plate 13 and the screwing head 2 is raised above it.

In the condition of FIG. 3B, the screwing head 2 is brought down over the cap in such a way that the mouth of the grip organ 20 grips the cap by interference. For this purpose, the cylindrical surface of the cap has, in a manner known in itself, an external knurling which co-operates with an inner knurled surface of the mouth 21 of the grip organ 20.

In the step of FIG. 3C the cap T, which by now is integral with the mouth of the grip organ 20, has been brought above the end surface of the neck of the bottle 4. FIG. 3C shows the thread 4*a* obtained on the neck of the bottle, destined to co-operate with the thread obtained on the inner surface of the cylindrical cladding of the cap T.

In the step of FIG. 3D, the screwing head 2 has remained axially in the same position relative to the bottle 4 whilst the thruster member 26 has been lowered relative to the grip organ 20, in order to drive the capsule body of the cap over the initial part of the thread of the bottle. Therefore, even before the screwing of the cap starts, the flat base 27 of the thruster member 26 is used advantageously, according to the invention, to obtain a correct mounting of the cap onto the bottle and thereby assure that the cap cannot be screwed with an orientation that is out of alignment relative to the bottle neck.

The condition of FIG. 3E corresponds to the start of the cap screwing step. In this step, the screwing head 2 transmits its rotation to the grip organ 20 which in turn transmits it to the cap T. The screwing step corresponds, in the cam tracks 9, 31, to the segment shown in FIG. 4 to the left of the position E, where it is seen that the cam track have a part with constant descent and the other one completely horizontal. During this screwing step, the thruster member continues to press against the cap T, whilst the screwing head has descended to perform the screwing operation.

The condition of FIG. 3F corresponds to the step in which, after completing the screwing operation, the screwing head 2 rises upwards again so the grip organ 20 exits from the engagement of the cap, whilst the thruster member 27 continues to exert its thrust against the cap. It should be noted that during the screwing step, the cap gripping organ continues to rotate until, once the tightening torque of the cap is reached, the clutch 22 slips, thereby causing the grip organ to stop. In this step, the body of the screwing head 2 continues to rotate and this even when the head continues to rise. The function of the thruster member 27 is also to prevent the entire bottle and the cap now integral therewith may rotate because of the rotation which the grip organ returns to have after its rise.

The condition of FIG. 3G corresponds to an intermediate step of the upwardly returning movement of the screwing head, whilst the condition of FIG. 3H corresponds to the reaching of the top dead centre. In the H-A segment, the element 27 is again recessed within the grip organ to be ready to draw a new cap.

As is readily apparent from the above description, the fundamental concept constituting the basis for the invention is to command the aforesaid thruster member in such a way as to exert a thrust on the cap in a step preceding the start of the screwing (to obtain the planting of the cap and its correct mounting onto the bottle) and/or during the screwing step (also to assure that the screwing operation occurs in a correct position) and/or after the completion of the screwing step (to prevent the whole bottle from being temporarily driven to rotate.

Naturally, without altering the principle of the invention, the construction details and the embodiments may vary widely from what is described and illustrated herein without thereby departing from the scope of the present invention.

For example, although in the case of the present invention the same element has been used which is traditionally used to eject the caps that remain jammed in the grip order, one could also provide a thruster member of any other kind and shape. It would also be possible to provide for the thruster member to act only in one of the steps set out above, or in any case not in all steps set out above.

What is claimed is:

1. A device for screwing a cap onto the neck of a bottle or similar container, comprising a screwing head able to move axially along a screwing axis and able to rotate about said axis to transmit said rotation to an organ for gripping the cap, in synchronism with the axial movement of the head, to cause the screwing of the cap onto the bottle, in which said grip organ has a tubular shape, with an end mouth which is able to receive and grip within it the cap, in which inside said tubular grip organ is mounted in sliding fashion a thruster member, wherein said device comprises means for controlling the axial position of the thruster member inside the grip organ which are so shaped as to cause a lowering of the thruster member within the grip organ, thereby thrusting it against the cap during at least a time interval between an instant in which the cap bears down onto the bottle, before the start of its screwing thereon, and an instant that is subsequent to the completion of the screwing operation, when the screwing head rises again, moving away from the cap.

2. A device as claimed in claim 1, wherein said means for controlling the axial position of the thruster member are able to thrust said thruster member in continuous fashion in the time interval between the two aforesaid instants.

3. A device as claimed in claim 1, wherein said means for controlling the axial position of the thruster member are able to thrust said thruster member against the cap during a step preceding the start of the screwing operation.

4. A device as claimed in claim 1, wherein said means for controlling the axial position of the thruster member are able to thrust said thruster member against the cap during the screwing operation.

5. A device as claimed in claim 1, wherein aforesaid means for controlling the axial position of the thruster member are able to thrust the thruster member against the cap in a step subsequent to the completion of the screwing step.

6. A machine using a plurality of devices as claimed in any of the previous claims, with a carrousel mechanism to move each screwing device about a central axis, in which said means for controlling the axial position of the thruster member of each screwing head are constituted by a stationary cam surface set circumferentially about the aforesaid central axis, which is engaged by a cam following organ associated to the thruster member of each screwing head.

7. A machine as claimed in claim 6, wherein said cam surface is constituted by an annular end surface of a cylindrical wall surrounding the aforesaid central axis and having a cylindrical surface bearing a circumferential throat constituting a cam track engaged by a cam following organ associated to each screwing head, in order to determine the axial position of the head during the operating cycle of the machine.

8. A method for screwing a cap onto the neck of a bottle or similar container, comprising a screwing head which is movable axially along a screwing axis and able to rotate about said axis to transmit a rotation to an organ for gripping the cap, in synchrony with the axial movement of the screwing cap, to cause the screwing of the cap onto the bottle, in which said grip organ has a tubular conformation, with an end mouth which is able to receive and grip within it the cap and in which within said tubular grip organ is slidably mounted a thruster member, wherein the axial position of the thruster member inside the grip organ is controlled in such a way as to cause a lowering of the thruster member inside the grip organ, thereby thrusting the thruster member against the cap at least in a time interval between the instant in which the cap is set down onto the bottle, before starting its screwing thereon, and an instant that is subsequent to the completion of the screwing operation, when the screwing head rises again moving away from the cap.

9. A method as claimed in claim 8, wherein said thruster member is thrust against the cap to cause a driving of the cap onto the neck of the bottle even before the start of the screwing step.

10. A method as claimed in claim 8, wherein said thruster member is pressed against the cap during the screwing step.

11. A method as claimed in claim 8, wherein said thruster member is pressed against the cap during a step subsequent to the completion of the screwing operation, when the screwing head is already rising again and moving away from the cap screwed on the bottle.

* * * * *